US005632527A

United States Patent [19]

Halder

[11] Patent Number: 5,632,527

[45] Date of Patent: May 27, 1997

[54] TOOL AND METHOD FOR THE REMOVAL OF FLOOR OR WALL SURFACING

[76] Inventor: Lorenz Halder, Am See 14, 88636 Illmensee, Germany

[21] Appl. No.: 190,048

[22] PCT Filed: Jun. 1, 1993

[86] PCT No.: PCT/DE93/00472

§ 371 Date: Jan. 31, 1994

§ 102(e) Date: Jan. 31, 1994

[87] PCT Pub. No.: WO93/24282

PCT Pub. Date: Sep. 12, 1993

[30] Foreign Application Priority Data

Jun. 2, 1992 [DE] Germany ..... 42 18 134.8

[51] Int. Cl.[6] ..... E21B 10/36; E01C 23/12; B25D 17/02

[52] U.S. Cl. ..... 299/100; 299/101

[58] Field of Search ..... 299/37, 69, 88, 299/86, 94, 39.8, 101, 107; 404/124, 133.05, 90; 175/415

[56] References Cited

U.S. PATENT DOCUMENTS

| | | | |
|---|---|---|---|
| 4,201,421 | 5/1980 | Den Besten et al. | 175/354 X |
| 4,342,486 | 8/1982 | O'Neill | 299/107 |
| 4,714,374 | 12/1987 | Mihara | 299/39.8 X |
| 4,784,517 | 11/1988 | Bergqvist | 299/86 X |

FOREIGN PATENT DOCUMENTS

| | | | |
|---|---|---|---|
| 495617 | 8/1953 | Canada | 404/124 |
| 0280003 | 8/1988 | European Pat. Off. . | |
| 0412287 | 2/1991 | European Pat. Off. . | |
| 671896 | 12/1929 | France . | |
| 1273042 | 8/1961 | France . | |
| 2563546 | 10/1985 | France . | |
| 539634 | 11/1931 | Germany . | |
| 867381 | 7/1949 | Germany | 299/94 |
| 6606562 | 11/1970 | Germany . | |
| 2345965 | 3/1974 | Germany . | |
| 2514746 | 10/1976 | Germany . | |
| 2730596 | 1/1978 | Germany . | |
| 36040192 | 6/1988 | Germany . | |
| 3722546 | 1/1989 | Germany . | |
| 3916186 | 11/1990 | Germany . | |
| 9106560.7 | 8/1991 | Germany . | |
| 2037223 | 7/1980 | United Kingdom . | |
| 2113143 | 8/1983 | United Kingdom . | |
| 91/10807 | 7/1991 | WIPO . | |

*Primary Examiner*—David J. Bagnell
*Attorney, Agent, or Firm*—Spencer & Frank

[57] ABSTRACT

A tool and a method for performing at least one of removing and treating high strength surfacing. The tool includes a plurality of cutting spikes including sintered-carbide tips, and a common carrier for transmitting at least one of striking and vibration forces to the cutting spikes. The cutting spikes are disposed on the common carrier, and can be arranged on the common carrier in a plurality of rows, the rows being offset relative to one another in a longitudinal direction of the common carrier. The common carrier may be a chisel including a striking pin and a chisel shank merging into the striking pin. The tool can further include a plurality of blunt spikes distributed among and set back relative to the cutting spikes on the common carrier.

10 Claims, 2 Drawing Sheets

TOOL AND METHOD FOR THE REMOVAL OF FLOOR OR WALL SURFACING

FIELD OF THE INVENTION

The invention relates to a tool for the removal or treatment of high-strength floor or wall surfacing, especially in industrial buildings. It is to be understood that "high strength surfacing" in the context of the invention refers to surfacing such as industrial topping finishes on raw concrete, e.g. wear coverings composed of magnesite, epoxy resin or some other synthetic resin, which are generally very hard and tough.

BACKGROUND OF THE INVENTION

Finishes such as those mentioned above are very difficult to remove in the course of conversion work. A known method is to cut the finishes away with a cutting roller which is fitted with cutting spikes with tungsten carbide tips. According to the above method, it is, for example, possible to achieve a cut groove 400 mm wide and 20 mm deep. However, such cutting rollers require a relatively heavy parent vehicle with a high driving power. With such a machine, it is possible to reach only a part of the floor surfaces in, for example, old buildings with their many nooks and crannies. This is due not only to narrow door openings but also because of the inadequate bearing capacity of intermediate floors. Those parts of the floor surfaces which cannot be reached must then be chipped away manually with an air hammer. Mention should also be made of the extremely large amount of dust which is generated when such cutters are used and this makes expensive suction devices necessary.

The object on which the invention is based is to propose a tool with which it is possible to improve the operations mentioned above in terms of lower costs for the machinery, better maneuvrability in buildings and the generation of less dust while achieving at least the same area coverage. A further object is to specify a tool by means of which relatively thin coatings just a few millimeters in thickness can be removed and surfaces can be merely roughened or precisely levelled.

SUMMARY OF THE INVENTION

The above object is achieved according to the invention by virtue of the fact that a plurality of cutting spikes with sintered-carbide tips as used, for example, on cutting rollers for road surfaces are arranged on a common carrier in strip or plate form which is intended and suitable for transmitting striking and/or vibration forces to the cutting spikes. The fundamental idea thus consists in using known cutting spikes, also often referred to as round-shank chisels, in a way hitherto unknown for such cutting spikes, namely in such a way that one cutting spike or a plurality of cutting spikes rest simultaneously with their tips on the covering to be removed or treated and are subjected to impact and/or vibration loading.

There are various fundamental advantages in comparison with a chiselling tool with a continuous cutting edge or individual tips. In particular, the tool described has a very long service life since the cutting spikes are virtually wear-free. Since the permanently sharp spikes penetrate easily into the material, the blows do not have to be so powerful. Thus, for the same effect on the covering to be removed or treated, smaller percussion or vibrating drives are sufficient and the loading on the intermediate floors is correspondingly lower. Also very important is the fact that steel reinforcements in the covering are not severed, the sintered-carbide tips being deflected by the reinforcement. The often desired partial exposure of reinforcements can thus be achieved rapidly and in a simple manner. The amount of dust generated is fundamentally less.

The cutting spikes are held with play in location holes in the carrier with the aid of clamping sleeves. However, they can also be held in cast-steel location housings which allow play, each of these housings having a location hole and being fixed, welded for example, to the carrier. In this way, it is possible to replace the spikes individually. Moreover, the above arrangement has the advantage that it is optionally possible to use cutting spikes whose sintered carbide tips are matched in terms of their metallic structure and their shape to the covering material to be removed or treated.

The cutting spikes can be arranged in a row on the carrier. The above arrangement is to be recommended for tearing up a covering. For finishing or roughening tools, on the other hand, an arrangement of the cutting spikes in a plurality of parallel rows is to be recommended and, in this arrangement, the rows should be offset relative to one another so that the spikes of adjacent rows are staggered in a longitudinal direction of the carrier. In addition, the rows can be curved or angular in plan view, and the carrier can also be matched to this shape. In the case of a penetrating tool with just one row of cutting spikes, the angular arrangement has the advantageous effect that the cracks which form in the covering to be removed continue the curved or angular shape. As a result, it is more easily possible to define beforehand the lumps which break away. Finishing tools with a plurality of cutting-spike rows in this shape can be more easily guided.

A preferred embodiment of the invention consists in designing the carrier as a chisel with a chisel shank which merges into a striking pin. Here the lower striking force which is required is of advantage insofar as the risk of breakage of the chisel shank is considerably lower. The cutting spikes are always arranged on the chisel parallel to the axis of the chisel shank. A finishing chisel is preferably designed in such a way that the tips of the cutting spikes of different rows lie in different planes perpendicular to the axis of the chisel shank.

A very handy chisel is obtained if a blunt, spade-shaped chisel blade is provided and the cutting spikes are inserted into a row of location holes made at the bottom edge of the blade. In order to be able to replace the cutting spikes easily, it is possible either to make a chamfer on the edge of the chisel blade so that the head of the spike can be knocked out by means of a conventional chisel, or to provide respective oblique holes cut into the surface of the chisel blade and emerging at the base of the location hole to allow the cutting spike to be knocked out by means of a drift.

A further variant of the invention consists in designing the carrier as a chisel pocket which can be slipped onto a wedge-shaped, spade-like chisel blade in a self-locking manner. The term chisel pocket is intended to mean a wedge-shaped hollow body, the size and angle of the inner wedge faces of which are matched precisely to the chisel blade of a conventional chisel with a spade-shaped blade.

In order to more easily to achieve a uniform working depth, it is expedient if the carrier has a number of blunt spikes distributed among the other cutting spikes and set back relative to the other cutting spikes. The blunt spikes form a depth stop relative to the surface of the covering when the sintered-carbide tips of the other cutting spikes have penetrated into the material of the covering. Such set-back spikes are intended particularly for larger-area or multi-row carriers.

While the chisels are used primarily with hydraulic hammers, including those which are additionally equipped with a vibrator, various other vibration generators are also suitable for the use of the tools proposed. Thus, for example, a carrier fitted with cutting spikes can form the vibrating plate of a vibrator or can be fixed to such a vibrating plate. The cutting spikes can project vertically downwards or be fitted so as to slope in the direction of the advance movement. For narrow spaces, it is also possible to use a backfill tamper, the tamper butt of which can again itself be designed as a carrier or be connected to a carrier fitted with cutting spikes. Finally, it is also conceivable that the shells of the roller elements of a travelling vibrating roller be fitted with radially projecting cutting spikes.

Where the intention is to use relatively large chisels of the type proposed, it is expedient to employ a compact loader with a lifting framework, to which a hydraulic hammer is attached. This makes it possible to use even heavy hydraulic hammers to advantage in buildings.

A preferred working method for the removal of floor or wall surfacing has recourse to a hydraulic hammer attached to a compact loader. The method consists of two operations. In the first operation, a relatively small, preferably single-row, chiselling tool is driven obliquely into the floor covering at one point in each case, causing the covering to break away in slabs or lumps. These lumps may achieve a considerable size depending on the floor covering. In a second operation, another, wider, flat finishing chiselling tool is passed continuously over the prepared surface. In the process, the remaining parts of the covering are broken away and the smooth, concrete-slurry surface of the raw concrete is roughened in order to achieve good adhesion of the new covering.

A particular advantage of this removal method is that it can adapt to the frequently varying thickness of the covering to be removed. Thus, the machine does not work to a particular depth, as with a revolving cutter. It is thereby possible to retain a significant proportion of the still usable subconcrete.

The tools proposed are also excellently suited to the roughening of hard smooth coverings to make them slip-proof or to ensure the adhesion of a newly applied coating. It is possible to remove plastic coatings within the millimeter range. There is also occasionally a requirement for very small removal depths where it is of importance to level the surface precisely or to improve the quality of the surface.

BRIEF DESCRIPTION OF THE DRAWINGS

Illustrative embodiments of the invention are explained below with reference to the drawings, in which.

Figure 2:
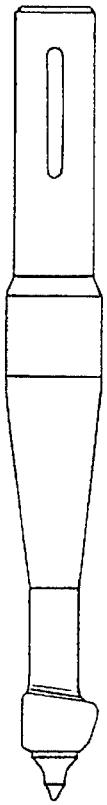
FIG. 2 shows the side view of the chisel according to FIG. 1.
Figure 1:
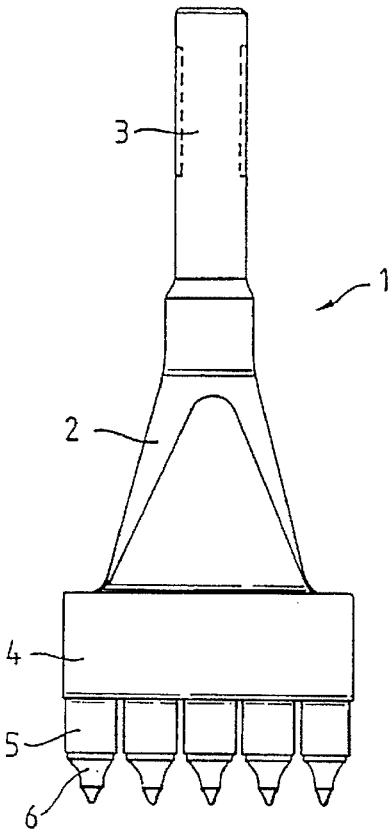
FIG. 1 shows the front view of a single-row chisel with cross-head.

The chisel 1 according to FIGS. 1 and 2 has a flat central part 2 which, at the top, merges into a striking pin 3. The latter fits into the hydraulic hammer shown in FIG. 9. Welded to the bottom of the central part 2 is a cross-head 4 of rectangular cross-section and, seated on the underside of the latter, likewise rigidly welded on and welded to one another, are the location housings 5 of five cutting spikes 6. Cutting spikes 6 are accommodated loosely in the location housings 5 (see FIG. 7). The axes of the spikes are parallel to one another and to the axis of the striking pin 3. Owing to the use of only five spikes, as in the example, the spikes penetrate the high strength surfacing, or covering, easily and, as a result, the covering breaks away in slabs, particularly when the tool is held at an angle to its surface.

Figure 4:
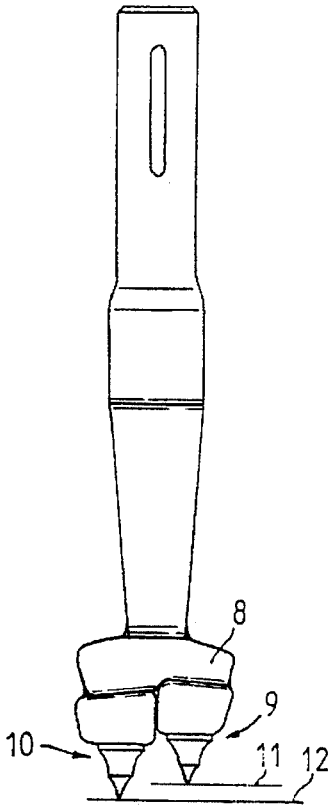
FIG. 4 shows the side view of the chisel according to FIG. 3.
Figure 3:
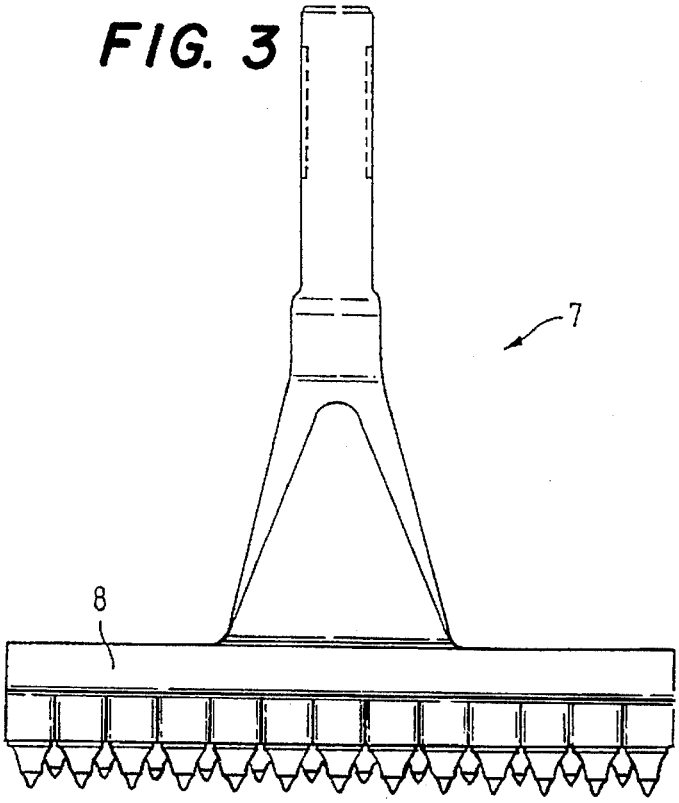
FIG. 3 shows the front view of a two-row chisel with cross-head.

The finishing chisel 7 depicted in FIGS. 3 and 4 carries two parallel rows of, respectively, twelve and thirteen spikes on a longer and broader cross-head 8, the two rows being offset in a staggered arrangement relative to one another in the longitudinal direction of the chisel. In addition, the spikes of the first row 9 are somewhat higher than the spikes of the second row 10, i.e. the tips of the spikes of the two rows lie in different transverse planes 11 and 12 relative to the axis of the striking pin. The axes of the spikes are all parallel to one another and parallel to the axis of the striking pin. In this finishing tool, there is a greater distribution of the striking force, the above arrangement. Depending on the striking force leads to the smashing of the remaining dome-shaped remainders of the covering or to the roughening of the worked surface. In this example, too, the location housings 5 of the spikes are welded to the cross-head 8.

Figure 6:
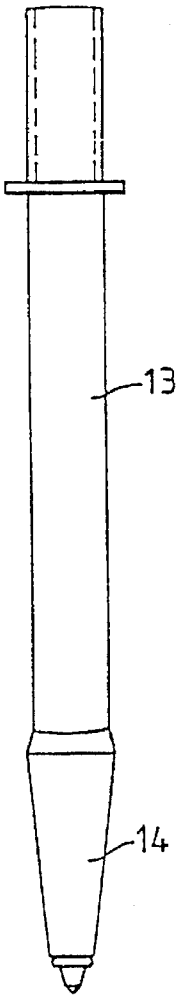
FIG. 6 shows the side view of the chisel according to FIG. 5.
Figure 5:
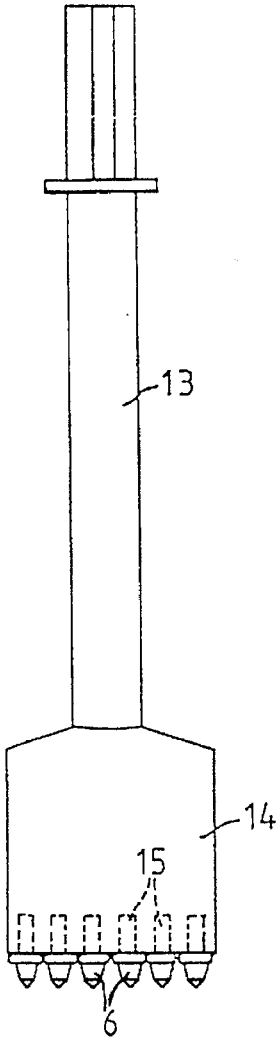
FIG. 5 shows the front view of a chisel with a spade-shaped chisel blade and cutting spikes held directly in location holes.
Figure 7:
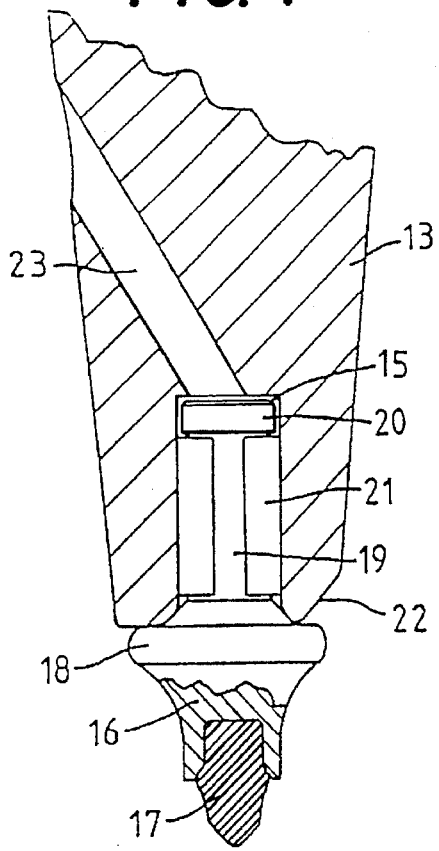
FIG. 7 shows a partial cross-section of the chisel blade according to FIG. 6 on a larger scale.

The chisel according to FIGS. 5 to 7 has a longer shank 13 and a forged, spade-shaped chisel blade 14 with surfaces which slope in a wedge shape relative to one another. Six location holes 15 are introduced into the blunt cutting edge of the chisel blade 14 from below, the holes lying in a row and being parallel to one another and to the shank 13. FIG. 7 shows that the cutting spikes 6 have a head part 16 with a brazed-in sintered carbide tip 17, a collar 18, a cylindrical shank 19 and a widened portion 20 on the end of the shank. A spring-steel clamping sleeve 21 split in the longitudinal direction is placed around the shank. This sleeve tends to spring open radially and thereby clamps itself in the location hole 15. The cutting spike 6 has radial and axial play in the location hole. On the other hand, cutting spike 6 is prevented from falling out because the widened portion 20 strikes against the upper end of the clamping sleeve 21.

Two measures, which can also be applied individually, are indicated for the removal of the inserted cutting spike. The bottom edge of the chisel blade has a chamfer 22 which makes it possible to place a standard chisel on the collar 18 of the cutting spike and to drive the latter out. In addition, an oblique hole 23 which opens into the location hole 15 is made. This makes it possible to drive out the cutting spike by means of a drift which fits into the hole 23.

Figure 8:
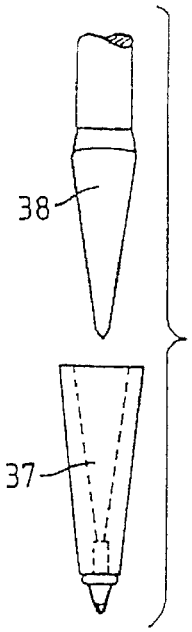
FIG. 8 shows the side view of a chisel pocket with the associated chisel.

FIG. 8 shows a chisel pocket 37 which has just one carrier, designed as a hollow body, and is intended to be slipped onto a conventional chisel which has a chisel blade 38 with a normal cutting edge. The outer surfaces of the chisel blade 38 and the inner surfaces of the chisel pocket must, of course, be matched to one another, especially with regard to their slope. Such a chisel pocket is lighter and cheaper than a complete chisel. It is intended as an accessory to compliment a standard chisel.

Figure 9:
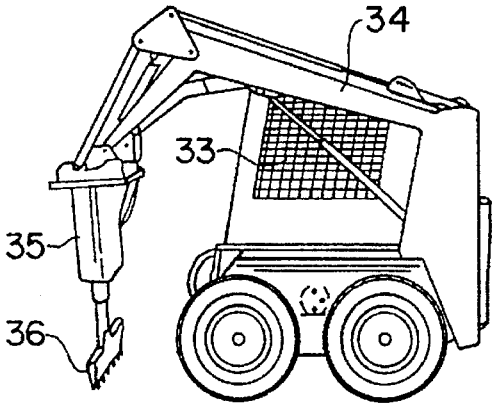
FIG. 9 shows a side view of a compact loader with a hydraulic hammer attached to the lifting framework.

Finally, FIG. 9 shows a compact loader. The driver is shielded by a protective grating 33. A lifting framework 34 can be moved with the aid of a plurality of hydraulic cylinders. Attached to the lifting framework is a 200 kg hydraulic hammer 35 and inserted into this is a chisel 36 provided with cutting spikes. The compact loader, which can be driven around on wheels can get through passages just 1 m wide and operate on intermediate floors with a loadbearing capacity of 1.5 t/m$^2$. Fuel consumption is very low. The dust generated during work with the chisel can be controlled by means of simple industrial vacuum cleaners.

For special applications, it is expedient to attach just one cutting spike to the chisel shank in the manner described and in this way to create a pointed chisel with a brazed-in sintered-carbide tip where the tip has play relative to the shank. Such a chisel could take the form shown in FIG. 6, although this figure shows the side of the chisel according to FIG. 5.

1 Chisel
2 Central part
3 Striking pin
4 Cross-head
5 Location housing
6 Cutting spike
7 Finishing chisel
8 Cross-head
9 Row of cutting spikes
10 Row of cutting spikes
11 Transverse plane
12 Transverse plane
13 Shank
14 Chisel blade
15 Location hole
16 Head part
17 Sintered-carbide tip
18 Collar
19 Shank
20 Widened portion
21 Clamping sleeve
22 Chamfer
23 Hole
33 Protective grating
34 Lifting framework
35 Hydraulic hammer
36 Chisel
37 Chisel pocket
38 Chisel blade

I claim:

1. A tool for performing at least one of removing and treating high strength surfacing comprising:

a plurality of cutting spikes including sintered-carbide tips; and a common carrier for transmitting at least one of striking and vibration forces to the cutting spikes, the cutting spikes being arranged on the common carrier in a plurality of rows, the rows being offset relative to one another in a longitudinal direction of the common carrier, the common carrier including:

a chisel having a wedge-shaped chisel blade; and a chisel pocket adapted to be slipped onto the chisel blade in a self-locking manner.

2. A tool for performing at least one of removing and treating high strength surfacing comprising:

a plurality of cutting spikes including sintered-carbide tips; and a chisel for transmitting at least one of striking and vibration forces to the cutting spikes, the chisel including a striking pin and a chisel shank merging into the striking pin, the cutting spikes being disposed on the chisel.

3. The tool according to claim 2, wherein the cutting spikes are arranged on the chisel in a row.

4. The tool according to claim 2, wherein:

the chisel shank defines a chisel shank axis; and the cutting spikes are disposed on the chisel such that their individual axes are parallel to the chisel shank axis.

5. The tool according to claim 2, wherein the chisel further includes a spade-shaped chisel blade having a bottom edge and defining a row of location holes made in the bottom edge thereof, the cutting spikes being inserted into respective ones of the location holes.

6. The tool according to claim 5, wherein the bottom edge includes a chamfer.

7. The tool according to claim 5, wherein each of the location holes includes a base, the chisel blade further defining respective oblique bores therein extending from a surface thereof to the base of each of the location holes.

8. A method for performing at least one of removing and treating high strength surfacing disposed on a floor with a tool according to claim 1, wherein the chisel includes a striking pin and a chisel shank merging into the striking pin, the method comprising the steps of:

driving the tool locally into a surface of the surfacing with a hydraulic hammer thereby breaking away individual lumps of the surfacing; and thereafter guiding the tool in a continuous manner over an entire surface of the floor for roughening the floor and breaking up residues of the surfacing.

9. The method according to claim 8, wherein the step of guiding the tool includes the step of guiding a tool wherein:

the chisel shank defines a chisel shank axis; and the cutting spikes are disposed on the chisel in a plurality of rows, the tips of cutting spikes being disposed in different rows lying in different planes defined in a direction perpendicular to the chisel shank axis.

10. A pointed chisel comprising:

a chisel shank defining an axial location hole therein;

a clamping sleeve disposed within the location hole of the chisel shank; and a cutting spike having a sintered-carbide tip and inserted into the location hole of the chisel shank, the clamping sleeve being effective for holding the cutting spike within the location hole with play.

* * * * *